US009602928B2

(12) United States Patent
Goto et al.

(10) Patent No.: US 9,602,928 B2
(45) Date of Patent: Mar. 21, 2017

(54) SPEAKER SYSTEM HAVING A SOUND COLLECTION UNIT FOR COMBINING SOUND WAVES

(71) Applicant: KABUSHIKI KAISHA TOSHIBA, Tokyo (JP)

(72) Inventors: Tatsuhiko Goto, Kanagawa (JP); Akihiko Enamito, Kanagawa (JP); Osamu Nishimura, Kanagawa (JP)

(73) Assignee: Kabushiki Kaisha Toshiba, Tokyo (JP)

( * ) Notice: Subject to any disclaimer, the term of this patent is extended or adjusted under 35 U.S.C. 154(b) by 45 days.

(21) Appl. No.: 14/644,949

(22) Filed: Mar. 11, 2015

(65) Prior Publication Data

US 2015/0271603 A1 Sep. 24, 2015

(30) Foreign Application Priority Data

Mar. 18, 2014 (JP) ..... 2014-055547

(51) Int. Cl.
*H04R 1/20* (2006.01)
*H04R 5/033* (2006.01)
*H04R 1/28* (2006.01)

(52) U.S. Cl.
CPC ..... *H04R 5/033* (2013.01); *H04R 1/2807* (2013.01); *H04S 2420/07* (2013.01)

(58) Field of Classification Search
CPC ..... H04R 1/02; H04R 1/2807
USPC ..... 381/338, 345, 351, 382
See application file for complete search history.

(56) References Cited

U.S. PATENT DOCUMENTS 4,087,629 A * 5/1978 Atoji ..... G10K 15/10 381/309
4,930,596 A * 6/1990 Saiki ..... H04R 1/2865 181/152
5,414,230 A 5/1995 Nieuwendijk et al.
5,694,475 A * 12/1997 Boyden ..... H04R 1/1066 381/327
2005/0008170 A1* 1/2005 Pfaffinger ..... H04S 7/30 381/96
2005/0270029 A1 12/2005 Ehman et al.
(Continued)

FOREIGN PATENT DOCUMENTS

JP 03-195296 8/1991
JP 5-29879 11/1993
(Continued)

*Primary Examiner* — Paul S Kim
*Assistant Examiner* — Katherine Faley
(74) *Attorney, Agent, or Firm* — Finnegan, Henderson, Farabrow, Garrett & Dunner LLP

(57) ABSTRACT

According to an embodiment, a speaker system includes filters, speakers, and a sound collection unit. Each of the filters filters a first signal to generate a second signal. The speakers are arranged so that transfer characteristics from the speakers to an evaluation point are different from each other. Each of the speakers converts the second signal generated by a corresponding one of the filters into a sound wave. The sound collection unit combines sound waves output from the speakers to generate a combined sound wave. The filters are formed so that a transfer characteristic from the first signal to an output signal matches a target transfer characteristic, the output signal indicating a sound pressure of the combined sound wave at the evaluation point.

14 Claims, 21 Drawing Sheets

(56) References Cited

U.S. PATENT DOCUMENTS

| | | | | |
|---|---|---|---|---|
| 2006/0253020 | A1 | 11/2006 | Ehman et al. | |
| 2007/0284184 | A1* | 12/2007 | Krueger | H04R 1/2857 181/151 |
| 2013/0266170 | A1* | 10/2013 | Yamagishi | H04R 1/22 381/353 |

FOREIGN PATENT DOCUMENTS

| | | |
|---|---|---|
| JP | 5-297879 | 11/1993 |
| JP | 6-202673 | 7/1994 |
| JP | 6-217961 | 8/1994 |
| JP | 9-105321 | 4/1997 |
| JP | 2743694 | 4/1998 |
| JP | 2818252 | 10/1998 |
| JP | 3038243 | 5/2000 |
| JP | 2009-195649 | 9/2009 |
| JP | 4885129 | 9/2009 |
| JP | 5047537 | 10/2012 |

* cited by examiner 0.141m × 0.165m × 0.51m 0.21m × 0.24m × 0.33m

SPEAKER SYSTEM HAVING A SOUND COLLECTION UNIT FOR COMBINING SOUND WAVES

CROSS-REFERENCE TO RELATED APPLICATIONS

This application is based upon and claims the benefit of priority from Japanese Patent Application No. 2014-055547, filed Mar. 18, 2014, the entire contents of which are incorporated herein by reference.

FIELD

Embodiments described herein relate generally to a speaker system.

BACKGROUND

A voice pipe or a tube speaker is used when disposition of a speaker is precluded due to a narrow space or a strong magnetic field environment such as a magnetic resonance imaging (MRI) apparatus. A speaker system using a pipe or a tube is likely to involve a difference in frequency characteristic between an input signal and an output signal. Furthermore, an increased length of the pipe or tube reduces output sound pressure.

DETAILED DESCRIPTION

Figure 1:
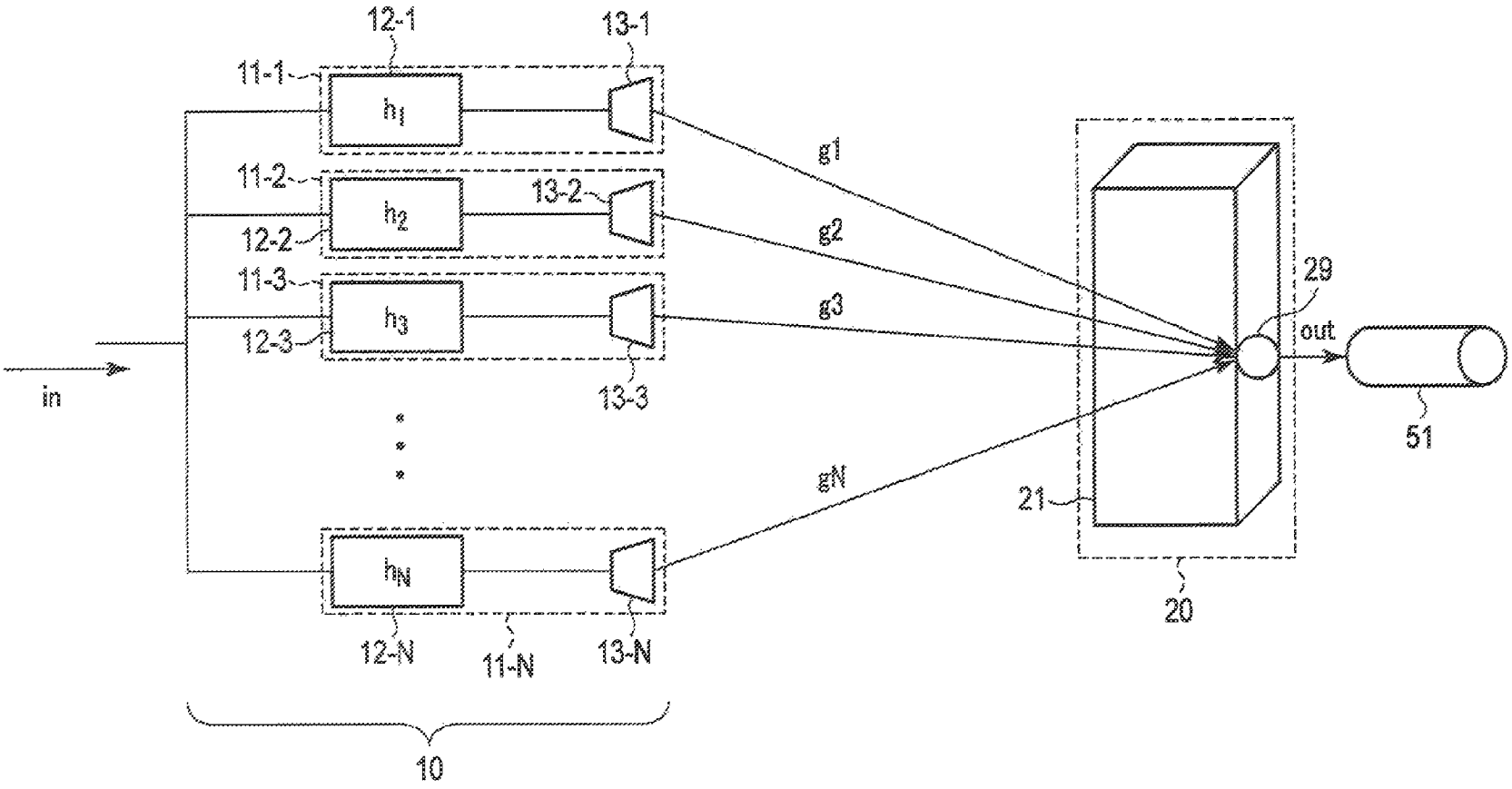
FIG. 1 is a schematic diagram depicting a speaker system according to an embodiment.

According to an embodiment, a speaker system includes a plurality of filters, a plurality of speakers, and a sound collection unit. Each of the plurality of filters filters a first signal to generate a second signal. The plurality of speakers are arranged so that transfer characteristics from the plurality of speakers to an evaluation point are different from each other. Each of the plurality of speakers converts the second signal generated by a corresponding one of the plurality of filters into a sound wave. The sound collection unit is configured to combine sound waves output from the plurality of speakers to generate a combined sound wave. The plurality of filters are formed so that a transfer characteristic from the first signal to an output signal matches a target transfer characteristic, the output signal indicating a sound pressure of the combined sound wave at the evaluation point.

Various embodiments will be described hereinafter with reference to the drawings. In the embodiments, the like elements are denoted by the like reference numerals, and duplicate descriptions are omitted.

A basic scheme for a speaker system according to an embodiment will be described with reference to FIG. 1.

FIG. 1 schematically depicts a speaker system according to an embodiment. The speaker system depicted in FIG. 1 includes a speaker unit 10 that emits sound based on an input signal, and a sound collection unit 20 that collects and transmits the sound emitted by the speaker unit 10, to a listener. The speaker unit 10 includes N sound wave generation units 11-1, 11-2, . . . , 11-N, where N is an integer of not less than 1. Each sound wave generation unit 11 includes a filter 12 and a speaker 13. Specifically, the sound wave generation units 11-1, 11-2, . . . , 11-N include filters 12-1, 12-2, . . . , 12-N and speakers 13-1, 13-2, . . . , 13-N, respectively.

A signal provided to each of the sound wave generation units 11-1, 11-2, . . . 11-N is the same as a signal input to the speaker unit 10. In each sound wave generation unit 11, the filter 12 filters the input signal, and the speaker 13 converts the signal output from the filter 12 into a sound wave. For example, in the sound wave generation unit 11-1, the filter 12-1 filters the input signal, and the speaker 13-1 converts the signal output from the filter 12-1 into a sound wave. The sound wave generation units 11-2, . . . , 11-N operate similarly to the sound wave generation unit 11-1. The sound collection unit 20 combines the sound waves emitted from the speakers 13-1, 13-2, . . . 13-N to generate a combined sound wave and guides the combined sound wave to an external auditory meatus 51 of a listener. The sound collection unit 20 includes a transmission part 21 that is a member to be worn by the listener to transmit the combined sound wave to the external auditory meatus 51 of the listener.

When N is 2 or more, the filters 12-1, 12-2, . . . , 12-N are designed to meet:

$$\sum_{i=1}^{N} h_i g_i = D \tag{1}$$

Here, $h_i$ denotes the transfer characteristic of the filter 12-*i*, $g_i$ denotes a transfer characteristic from the speaker 13-*i* to an evaluation point 29, and D denotes a target transfer characteristic from the input signal to an output signal (that is the sound pressure of the combined sound wave at the evaluation point 29). The transfer characteristics $g_1, g_2, \ldots g_N$ are pre-measured. The evaluation point 29 corresponds to a position where an evaluation microphone is placed in order to measure the transfer characteristics $g_1, g_2, \ldots, g_N$. The evaluation point 29 is set, for example, in the transmission part 21 of the sound collection unit 20. The evaluation point 29 is desirably set at a position where the entrance to the external auditory meatus 51 of the listener is supposedly located. Moreover, the speakers 13-1, 13-2, . . . , 13-N are arranged so that the transfer characteristics $g_1, g_2, \ldots, g_N$ are different from each other.

In general, the target transfer characteristic D is desirably a frequency characteristic that is flat all over the frequency band. However, in actuality, the target transfer characteristic D is set with the characteristics of the speaker itself and spatial characteristics taken into account, so as to exhibit a flat frequency characteristic in a specified frequency band. For example, when music is reproduced, a frequency characteristic between 100 Hz and 20 kHz may be flat, and the band with a flat frequency characteristic need not be further extended. Furthermore, when the speaker system is applied to an active noise control system, the transfer characteristic may be set so as to have a flat frequency characteristic between 100 Hz and 2 kHz because noise signals that the active noise control system attempts to reduce generally have low frequencies. Thus, the transfer characteristic is determined depending on the situation.

When the transfer characteristics $h_1, h_2, \ldots, h_N$ of the filter 12-1, 12-2, . . . , 12-N meet Formula (1), the transfer characteristic from an input signal (in) to an output signal (out) matches the target transfer characteristic. A method for determining the transfer characteristics $h_1, h_2, \ldots h_N$ that meet Formula (1) may be, for example, MINT (multiple-input/output inverse filtering theorem). A method for designing the filters 12-1, 12-2, . . . , 12-N is not limited to the use of MINT, and any other method may be used to design the filters 12-1, 12-2, . . . , 12-N.

Some of the filters 12-1, 12-2, . . . 12-N may have a transfer characteristic set to be a through characteristic. The filters with the through characteristic may output the input signal directly to the speaker.

When N is 1, that is when one speaker 13-1 is provided, a filter with an approximate inverse characteristic $h_1$ of the transfer characteristic $g_1$ is used as the filter 12-1. However, in this case, the transfer characteristic from the input signal to the output signal deviates from the target transfer characteristic.

As described above, in the speaker system according to the embodiment, the transfer characteristics $h_1, h_2, \ldots, h_N$ of the filters 12-1, 12-2, . . . , 12-N are determined so that the transfer characteristic from the input signal to the output signal matches the target transfer characteristic. The target transfer characteristic is set to have a flat frequency characteristic over a desired frequency band. This enables a reduction in the difference in frequency characteristic between the input signal and the output signal.

In the embodiments described below, an example will be described in which a tube is used to transmit a sound wave from each speaker 13 to the sound collection unit 20. The tube refers to a hollow tube or pipe through which a sound wave can be transmitted. The tube may be, for example, a flexible tube made of a flexible material such as resin. When the tube is made of a nonmagnetic material, the speaker system can be used even in a strong magnetic field environment such as an MRI apparatus. When utilized for an MRI apparatus, the speaker system can be used to reduce noise or to provide voice instructions and music to a subject. Furthermore, the use of a flexible tube allows the speaker system to be applied even when the listener is positioned in a narrow space.

The transmission of a sound wave from each speaker 13 to the sound collection unit 20 may be spatial transmission without a tube as in the speaker system depicted in FIG. 1. In this case, the transmission part 21 may be a conical member; for example, a megaphone. When a megaphone is used as the transmission part 21, the megaphone is installed on the listener so that a narrower end thereof is directed to the listener's ear, whereas a wider end thereof is directed to the speakers 13-1, 13-2, . . . , 13-N.

First Embodiment

A first embodiment relates to a speaker system in which a tube is connected directly to a speaker.

Figure 2:
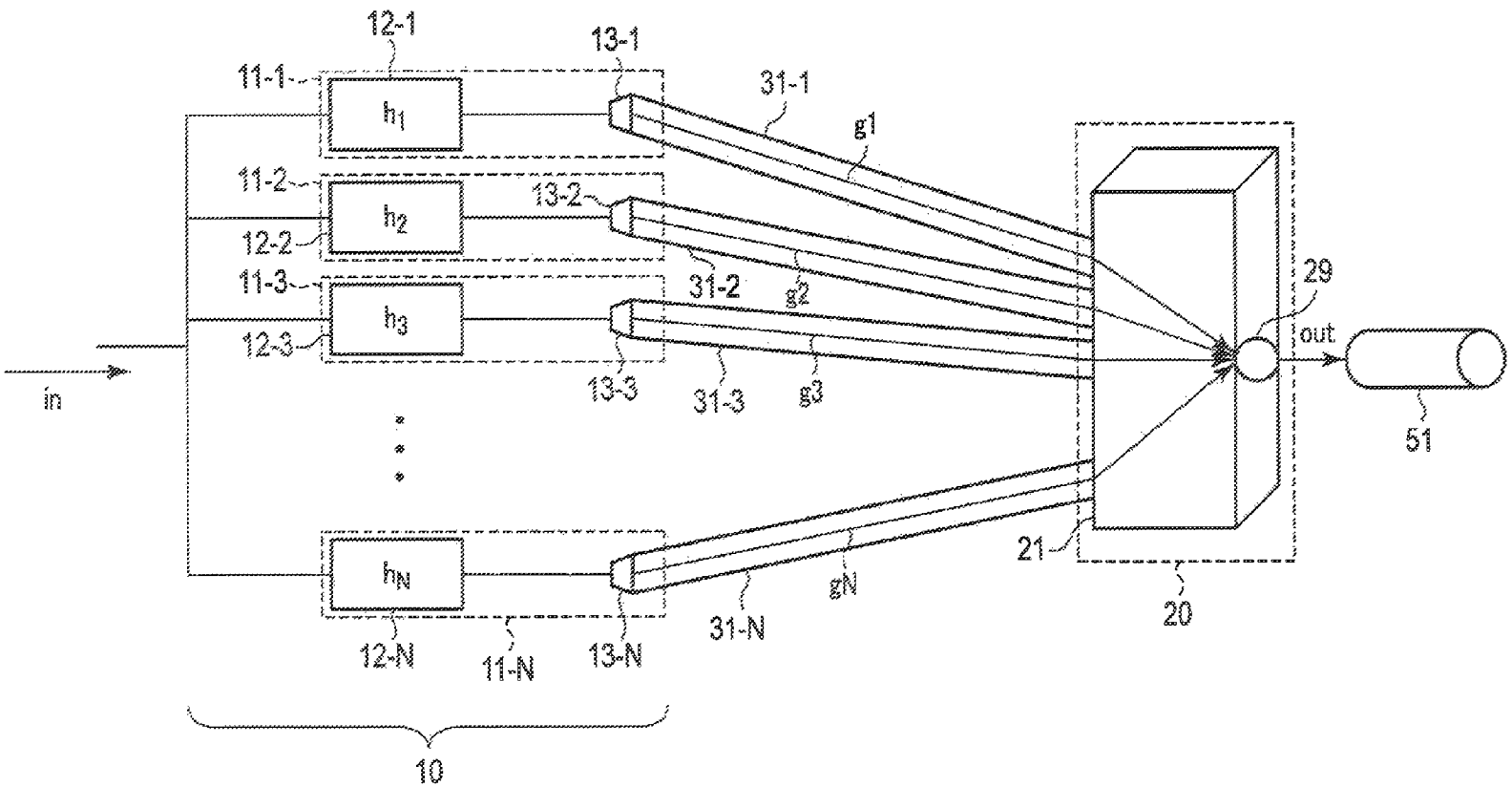
FIG. 2 is a schematic diagram depicting an example of the speaker system according to a first embodiment.
Figure 3:
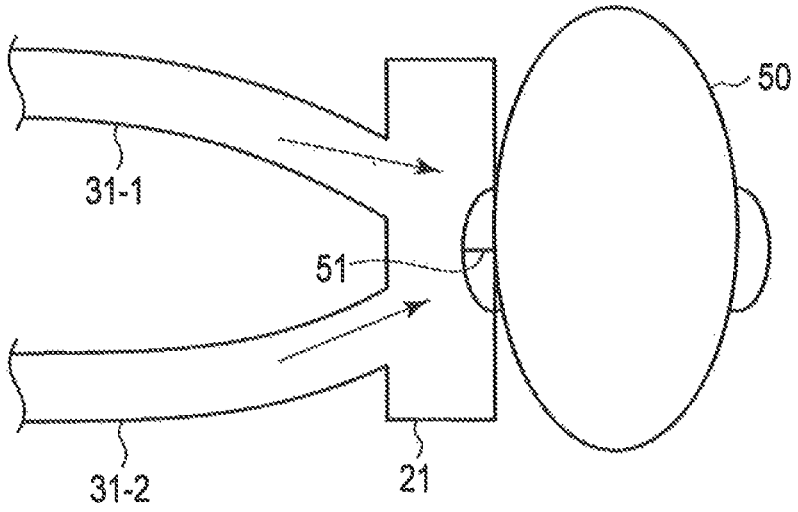
FIG. 3 is a schematic diagram depicting an example of a transmission part depicted in FIG. 2.

FIG. 2 schematically depicts an example of the speaker system according to the first embodiment. In the speaker system depicted in FIG. 2, tubes 31-1, 31-2, . . . , 31-N are provided between the speakers 13-1, 13-2, . . . , 13-N and the transmission part 21 of the sound collection unit 20. One end of each tube 31 is connected to the speaker 13, and the other end of the tube 31 is connected to the transmission part 21. Sound waves emitted from the speakers 13-1, 13-2, . . . , 13-N propagate through the tubes 31-1, 31-2, . . . , 31-N, respectively, to the transmission part 21. When the tubes 31-1, 31-2, . . . , 31-N are connected directly to the transmission part 21, the transmission part 21 is an ear muff like an ear pad of a headphone which covers the external ear of a listener 50 as depicted in FIG. 3. FIG. 3 depicts an example where the two tubes 31-1 and 31-2 are connected to the ear muff 21. Spaces defined by inner walls of the tubes 31-1 and 31-2, that is, transmission paths of sound waves are in communication, via a hole in a side surface of the ear muff 21, with a space defined by the ear muff 21 and the external auditory meatus of the listener 50. The ear muff is an example of the transmission part 21. The transmission part 21 may be a member with another shape.

Figure 4:
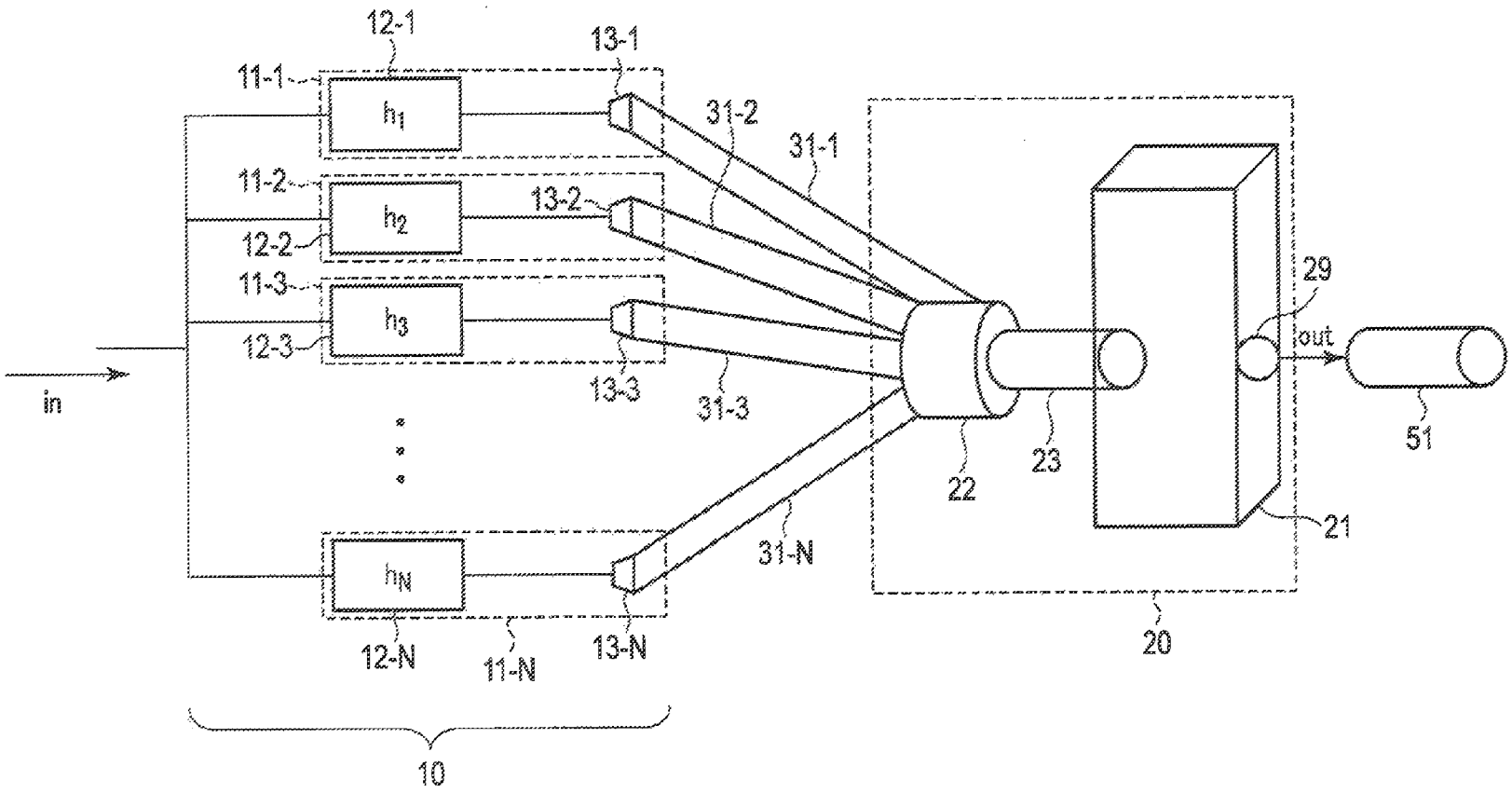
FIG. 4 is a schematic diagram depicting another example of the speaker system according to the first embodiment.

FIG. 4 schematically depicts another example of the speaker system according to the first embodiment. In the speaker system depicted in FIG. 4, the sound collection unit 20 includes the transmission part 21, a path joining part 22, and a transmission tube 23. In this example, one end of each tube 31 is connected to the speaker 13, and the other end of the tube 31 is connected to the path joining part 22.

Figure 5:
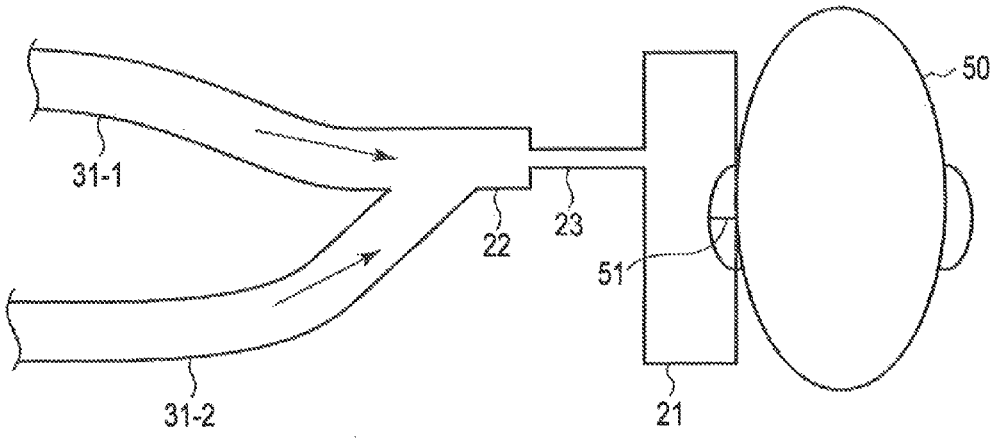
FIG. 5 is a schematic diagram depicting an example of a transmission part depicted in FIG. 4.
Figure 6:
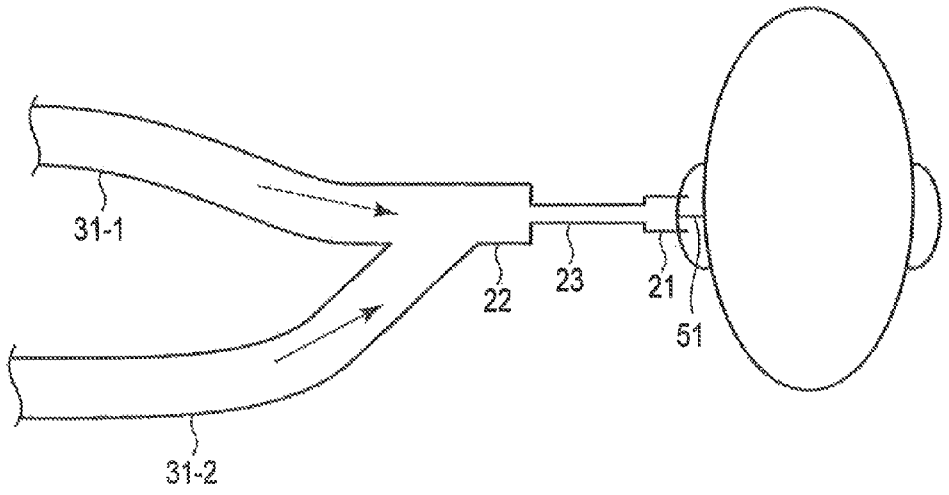
FIG. 6 is a schematic diagram depicting another example of the transmission part depicted in FIG. 4.

Transmission paths of sound waves emitted from the speakers 13-1, 13-2, . . . , 13-N join together at the path joining part 22 to combine the sound waves. The combined sound wave propagates from the path joining part 22 to the transmission part 21 via the transmission tube 23. The transmission part 21 transmits the combined sound wave to the external auditory meatus 51 of the listener 50. When the path joining part 22 is provided, the transmission part 21 may be an ear muff that covers the ear of the listener 50 as depicted in FIG. 5 or an earphone that can be inserted into the external auditory meatus 51 of the listener 50 as depicted in FIG. 6. Compared to the ear muff-like transmission part 21, the earphone-like transmission part 21 is advantageously likely to eliminate the adverse effect of the shape of the external ear, thus enabling a reduction in the adverse effect of an individual difference.

Provision of the path joining part 22 that connects the tubes 31-1, 31-2, . . . , 31-N together prevents the tubes 31-1, 31-2, . . . , 31-N from causing an obstruction when the listener 50 puts on the transmission part 21. However, the transfer characteristic from the path joining part 22 to the evaluation point 29 is the same among the speakers 13-1, 13-2, . . . , 13-N, thus making design of the filters 12-1, 12-2, . . . , 12-N difficult. Hence, the transmission tube 23, which is a common element, is desirably no longer than necessary.

Figure 7:
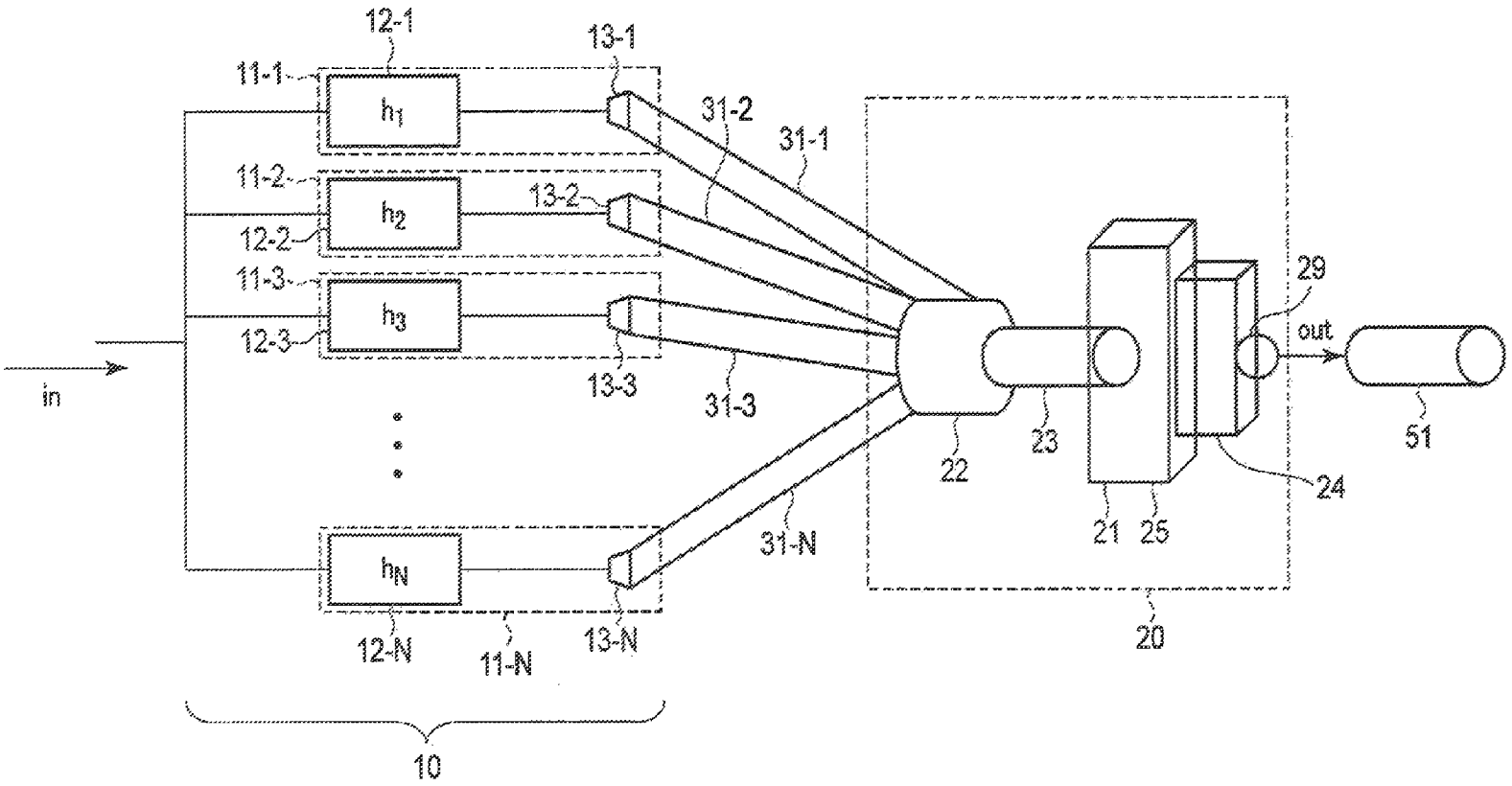
FIG. 7 is a schematic diagram depicting yet another example of the speaker system according to the first embodiment.
Figure 8:
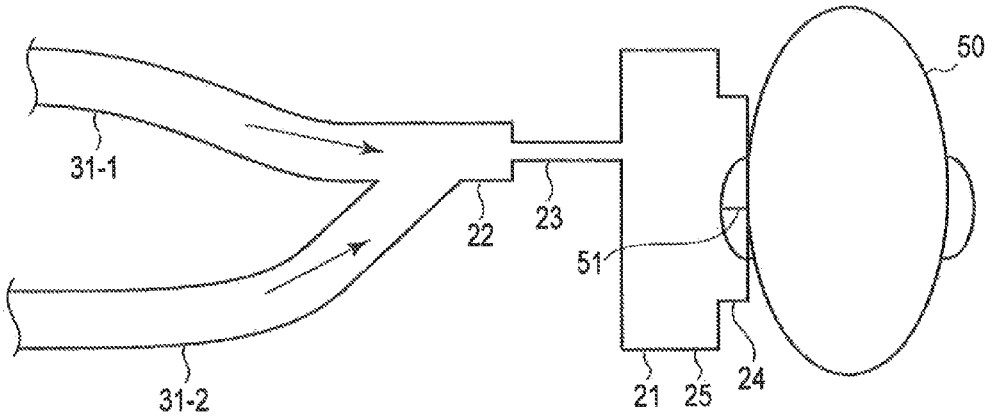
FIG. 8 is a schematic diagram depicting an example of a transmission part depicted in FIG. 7.

FIG. 7 schematically depicts yet another example of the speaker system according to the first embodiment. In the speaker system depicted in FIG. 7, the transmission part 21 includes a first part 25 and a second part 24 having a cross section different from the cross section of the first part 25. As depicted in FIG. 8, the tube 23 is connected to the first part 25, and the second part 24 is worn by the listener. The second part 24 can be replaced with another second part with a different cross section. When the transmission part 21 internally includes parts with different cross sections, the sound volume of medium and low frequency bands can be adjusted. As a result, a reduced sound pressure resulting from transmission through the tube can be compensated for.

Figure 9:
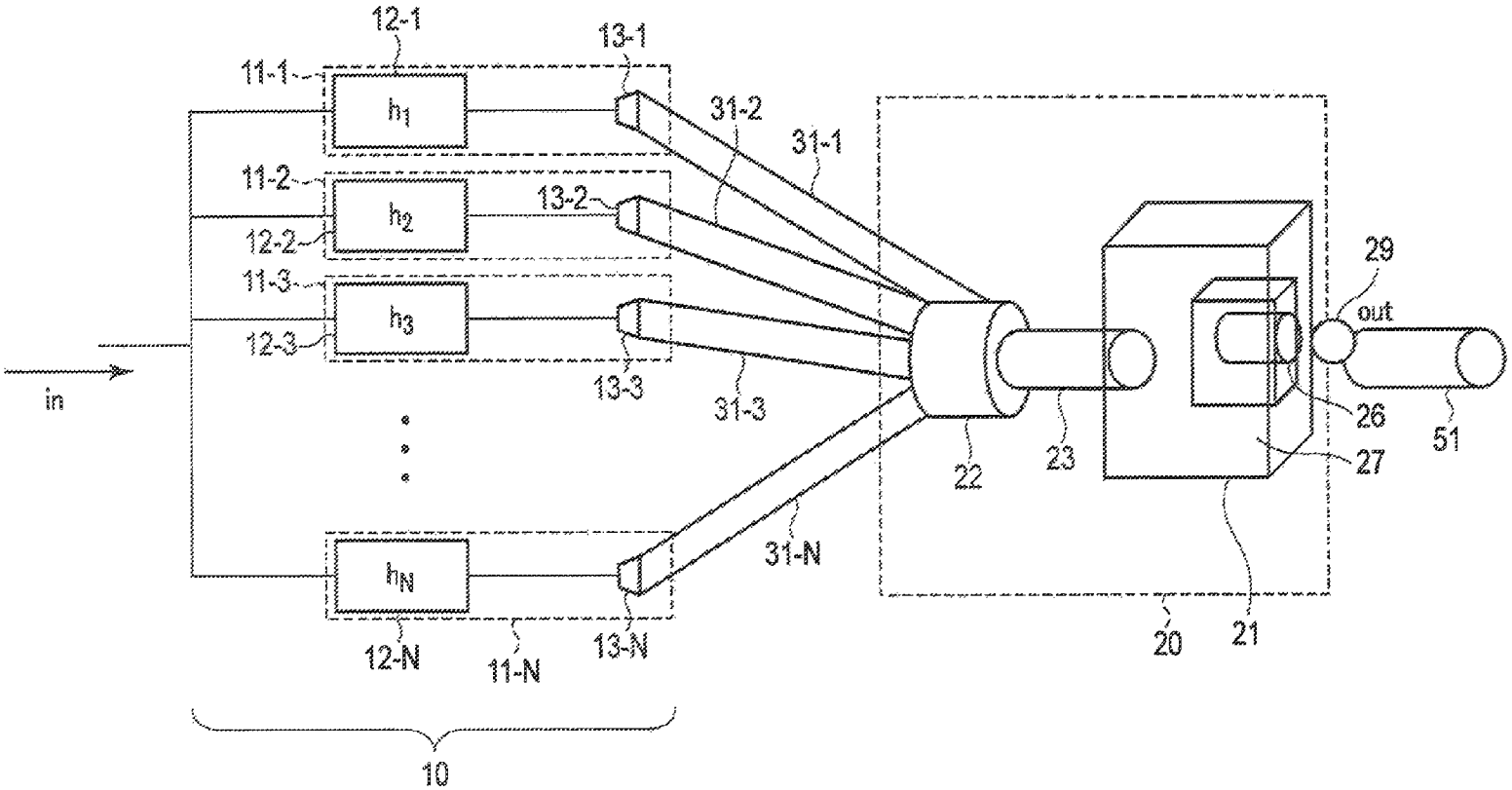
FIG. 9 is a schematic diagram depicting still another example of the speaker system according to the first embodiment.
Figure 10:
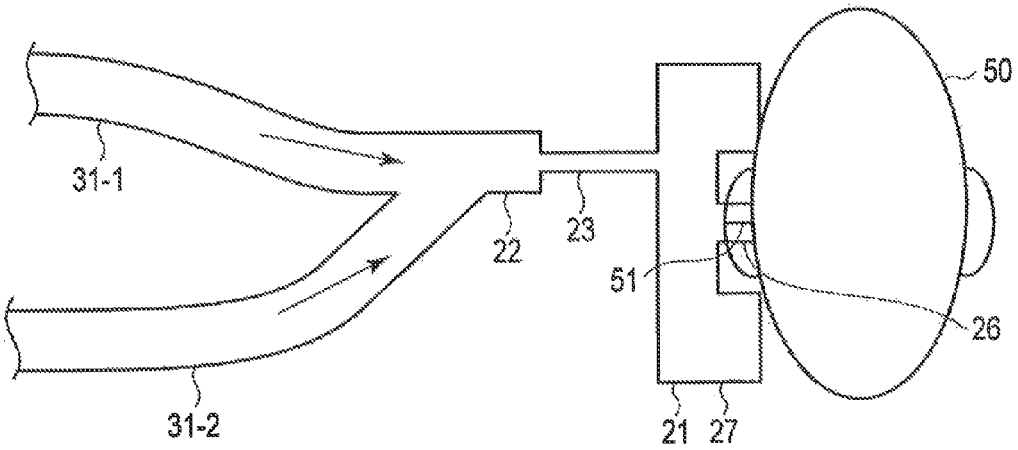
FIG. 10 is a schematic diagram depicting an example of a transmission part depicted in FIG. 9.

FIG. 9 schematically depicts still another example of the speaker system according to the first embodiment. In the speaker system depicted in FIG. 9, the transmission part 21 includes a main body part 27 with an internal space and a tube part 26 connected to the main body part 27 and extending from the main body part 27. As depicted in FIG. 10, when the listener 50 wears the transmission part 21, the main body part 27 is in abutting contact with the listener 50. A leading end of the tube part 26 is positioned near the external auditory meatus 51 of the listener 50 when the listener 50 wears the transmission part 21. For example, the part of the transmission part 21 that is in abutting contact with the listener 50 includes a buffer material such as a cushion (not depicted in the drawings). The transmission part 21 corresponds to a combination of the characteristics of an ear muff and the characteristics of an earphone. The transmission part 21 allows the external auditory meatus 51 of the listener 50 to be excluded from the transmission path, thus enabling a reduction in the adverse effect of an individual difference. Moreover, unlike the earphone, the transmission part 21 does not require the tube part 26 to be inserted into the external auditory meatus, allowing suppression of the listener's discomfort with the transmission part 21. Furthermore, the ability to increase the sound pressure in the internal space of the main body part 27 enables a reduced sound pressure resulting from transmission through the tube to be compensated for.

Now, the results of simulation executed on the sound collection unit 20 that is a combination of the structures depicted in FIG. 7 and FIG. 9 will be described.

Figure 11A:
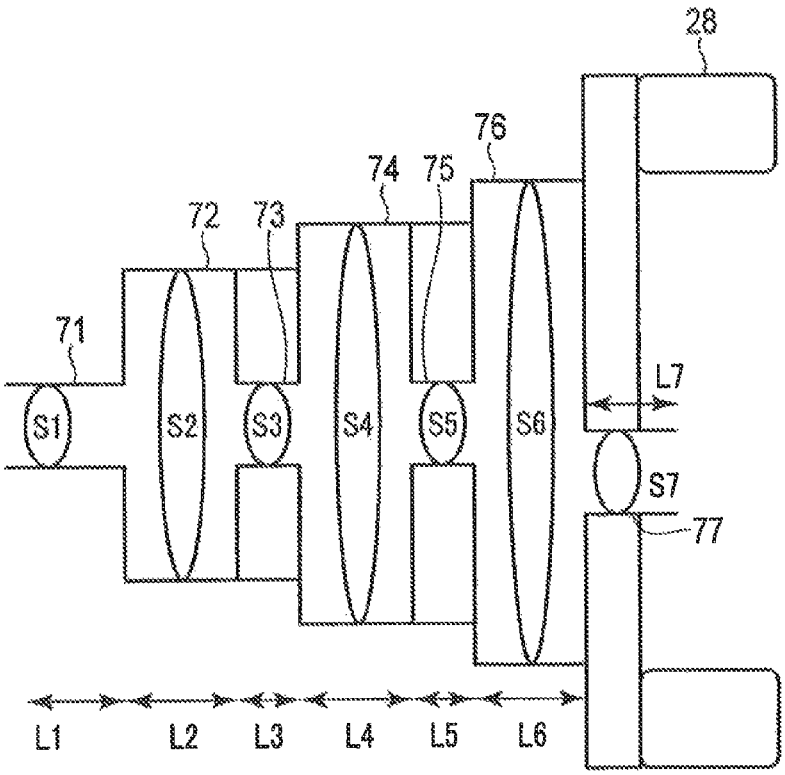
FIG. 11A and FIG. 11B are a cross-sectional view and a side view depicting a sound collection unit used for simulation.
Figure 11B:
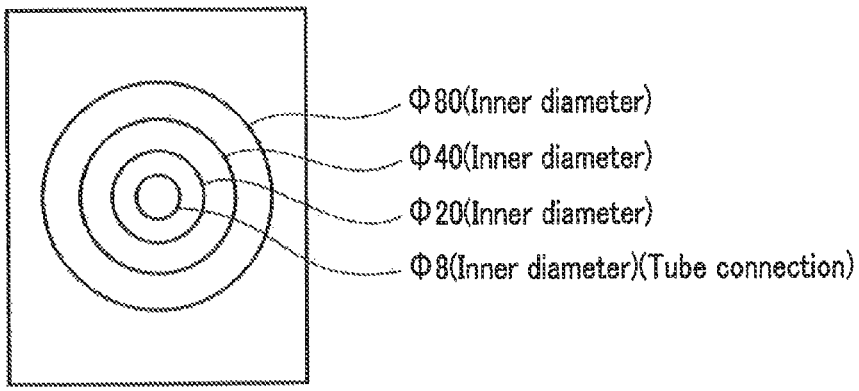

FIG. 11A and FIG. 11B are a cross-sectional view and a side view depicting the sound collection unit 20 used for the simulation. The sound collection unit 20 includes seven parts 71 to 77 as depicted in FIG. 11A. Each of the parts 71 to 77 is shaped like a circle in cross section. Furthermore, the parts 71 to 76 are shaped like concentric circles in cross section as depicted in FIG. 11B. When the parts 71 to 77 have cross sections denoted by S1 to S7, S1=S3=S5=S7=0.004 m×0.004 m×π, S2=0.01 m×0.01 m×π, S4=0.02 m×0.02 m×π, and S6=0.04 m×0.04 m×π. That is, the sound collection unit 20 includes the three parts 72, 74, and 76 with different cross sections. When the lengths of the parts 71 to 77 are denoted by L1 to L7, L1=L3=L5=0.001 m, L2=L4=L6=0.003 m, and L7=0.007 m. The lengths are defined in a direction orthogonal to the cross sections. The sound collection unit 20 includes a closed space from which the listener's external auditory meatus is excluded. Moreover, a cushion 28 is provided on a side of the sound collection unit 20 on which the listener is positioned.

Figure 12:
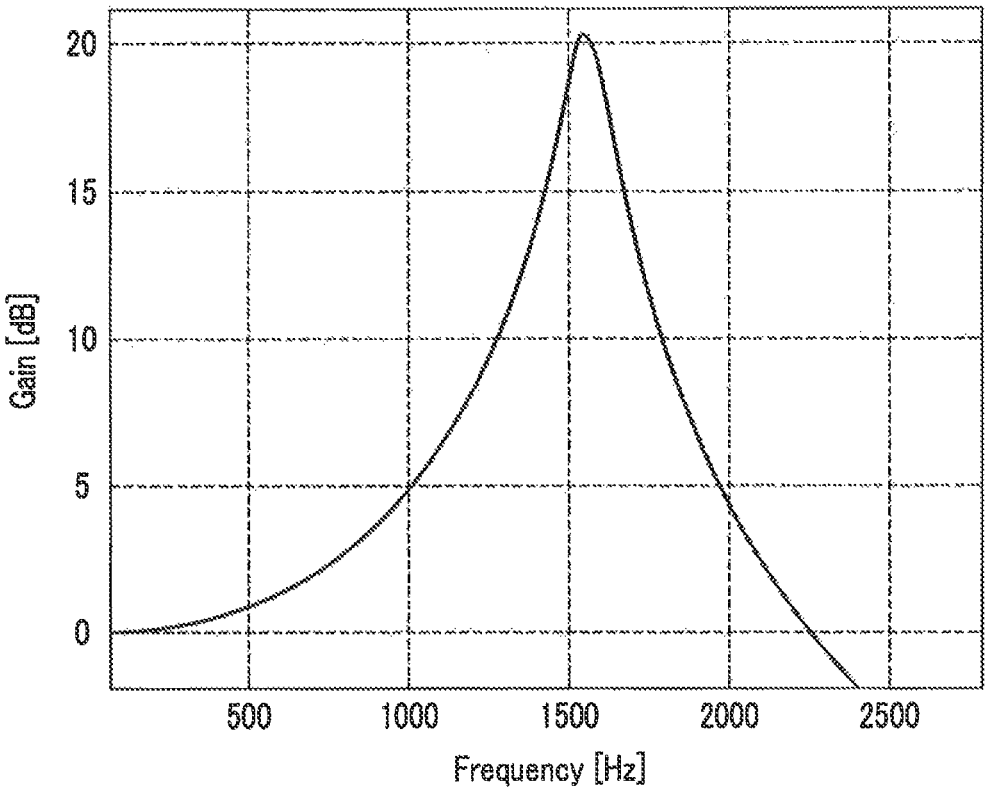
FIG. 12 is a diagram depicting a simulation result for the speaker system according to the first embodiment.

FIG. 12 depicts the transfer characteristic from an inlet (a duct inlet with the cross section S1 and the length L1) to an outlet (a duct outlet with the cross section S7 and the length L7) which characteristic has been obtained through simulation using the sound collection unit 20 depicted in FIG. 11. FIG. 12 indicates that a sound amplification effect is exerted in a frequency band between approximately 500 Hz and 2 kHz. As described above, the use of the sound collection unit 20 that is the combination of the structures in FIG. 7 and FIG. 9 enables an increase in the sound volume of the medium and low frequency bands, allowing a reduced sound pressure resulting from transmission through the tube to be compensated for. The cross sections S1 to S7, the lengths L1 to L7, and the number of parts with different cross sections, all depicted in FIG. 11, are design parameters and can be set in accordance with frequency bands intended for sound amplification.

As described above, in the speaker system according to the first embodiment, sound waves are transmitted using the plurality of transmission paths with different transfer characteristics. Thus, bands with frequency characteristics that fail to be achieved by a single transmission path can be compensated for by the other transmission paths. That is, the difference in frequency characteristic between the input signal and the output signal can be reduced by using the filters designed to make the transfer characteristic from the input signal to the output signal flat over the desired frequency band.

Second Embodiment

In the first embodiment, the speaker is connected directly to the tube. According to a second embodiment, the speaker is connected to the tube via a resonance box. The sound volume can be increased by utilizing a sound resonance phenomenon in a resonance box. Furthermore, when the speaker is directly connected to the tube, sound may leak from the connection between the speaker and the tube. In the second embodiment, such sound leakage can be effectively suppressed by connecting the speaker to the tube via the resonance box.

Figure 13:
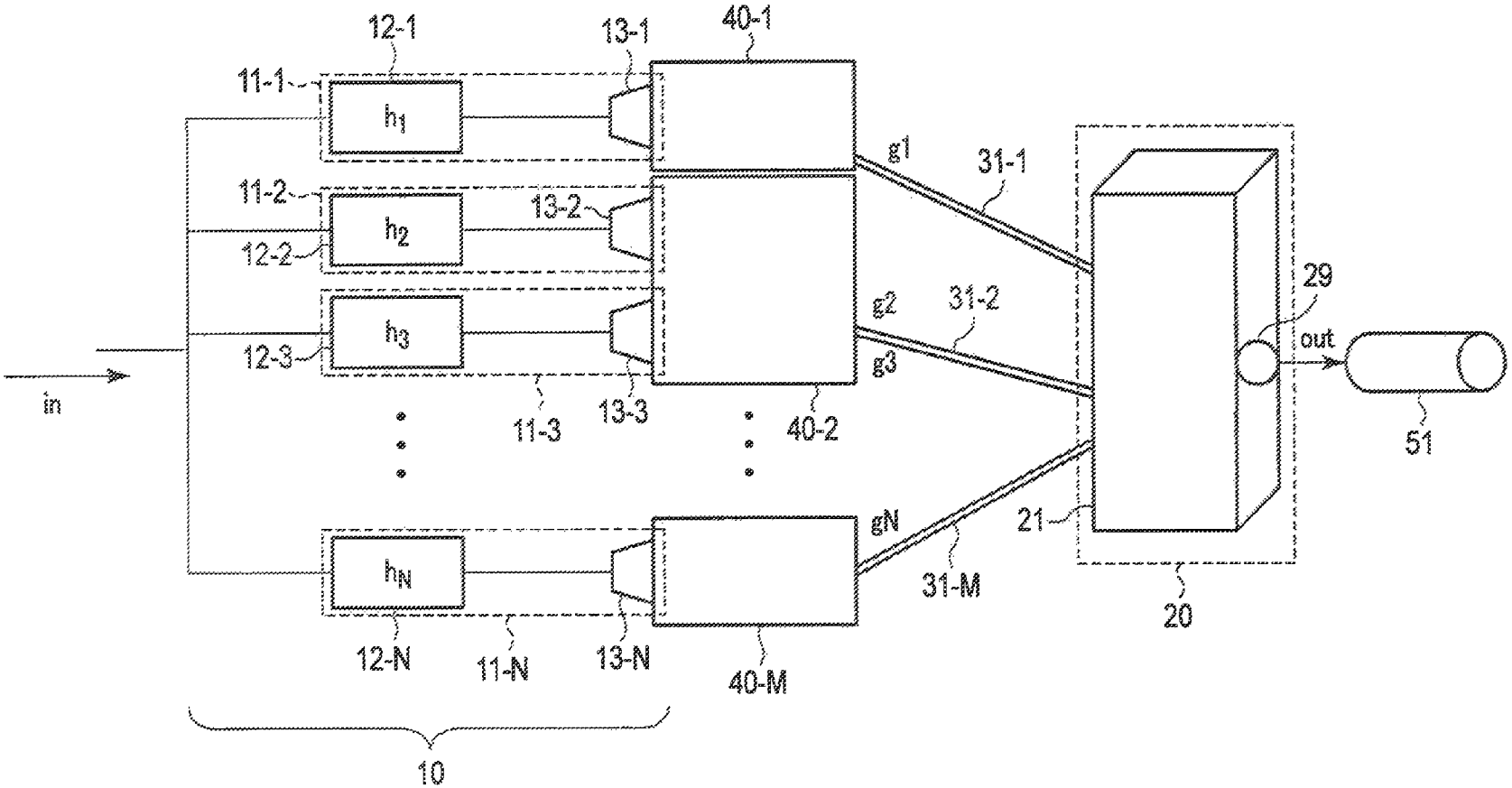
FIG. 13 is a schematic diagram depicting an example of a speaker system according to a second embodiment.

FIG. 13 schematically depicts an example of a speaker system according to the second embodiment. The speaker system depicted in FIG. 13 is different from the speaker system depicted in FIG. 2 in that the speaker system depicted in FIG. 13 includes M resonance boxes 40-1, 40-2, . . . 40-M, where, M is an integer of not less than 1 and not more than N. Each resonance box 40 is a closed-box-like member with an internal space. A speaker 13-1 is fixed to the resonance box 40-1 so as to emit sound waves into the internal space of the resonance box 40-1. A hole is formed in a sidewall of the resonance box 40-1, and a tube 31-1 is attached to this hole. The tube 31-1 connects the resonance box 40-1 to a transmission part 21 of a sound collection unit 20.

Speakers 13-2 and 13-3 are fixed to the resonance box 40-2 so as to emit sound waves into the internal space of the resonance box 40-2. The resonance box 40-2 is connected to the transmission part 21 via a tube 31-2. Moreover, a speaker 13-N is fixed to the resonance box 40-M so as to emit sound waves into the internal space of the resonance box 40-M. The resonance box 40-M is connected to the transmission part 21 via a tube 31-M.

In the example in FIG. 13, the resonance box 40-1 is provided with one speaker 13-1, and the resonance box 40-2 is provided with two speakers 13-2 and 13-3. Alternatively, one resonance box 40 may be provided with three or more speakers 13. Alternatively, each resonance box 40 may be provided with one speaker 13. Specifically, the speakers 13-1, 13-2, . . . , 13-N are provided for the resonance boxes 40-1, 40-2, . . . , 40-N, respectively. Moreover, at least one of the speakers 13-1, 13-2, . . . , 13-N may be connected directly to the tube 31 with no resonance box 40 between the speaker and the tube. The speakers 13-2 and 13-3 are arranged on the same wall surface of the resonance box 40-2 but may be arranged on different wall surfaces. In the resonance box 40, a speaker position and a tube connection position can be optionally set. Moreover, the resonance box 40 has an average sound absorption coefficient that can be freely set.

Figure 14:
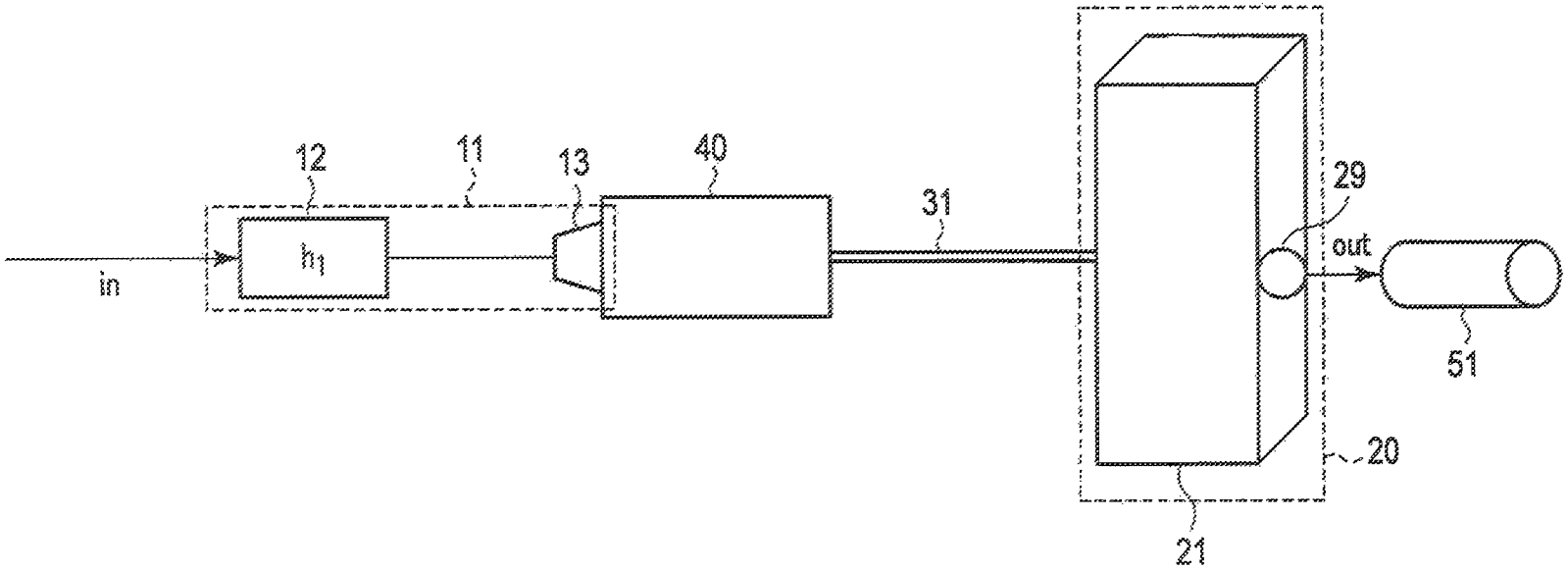
FIG. 14 is a schematic diagram depicting another example of the speaker system according to the second embodiment.

FIG. 14 schematically depicts another example of the speaker system according to the second embodiment. An example depicted in FIG. 14 corresponds to the speaker system depicted in FIG. 13 and in which N=1. That is, the speaker system depicted in FIG. 14 includes one sound wave generation unit 11. The sound wave generation unit 11 includes a filter 12 having a transfer characteristic $h_1$ to filter an input signal, and a speaker 13 that converts a signal output from the filter 12 into a sound wave. The transfer characteristic $h_1$ is an approximate inverse characteristic of a transfer characteristic $g_1$ from the speaker 13, to an evaluation point 29 in the sound collection unit 20. The speaker 13 is fixed to the resonance box 40. A sound wave output from the speaker 13 is resonated and amplified in the resonance box 40 and propagates through the tube 31 to the transmission part 21 of the sound collection unit 20. The transmission part 21 transmits the incoming sound wave to the external auditory meatus 51 of the listener.

Figure 15:
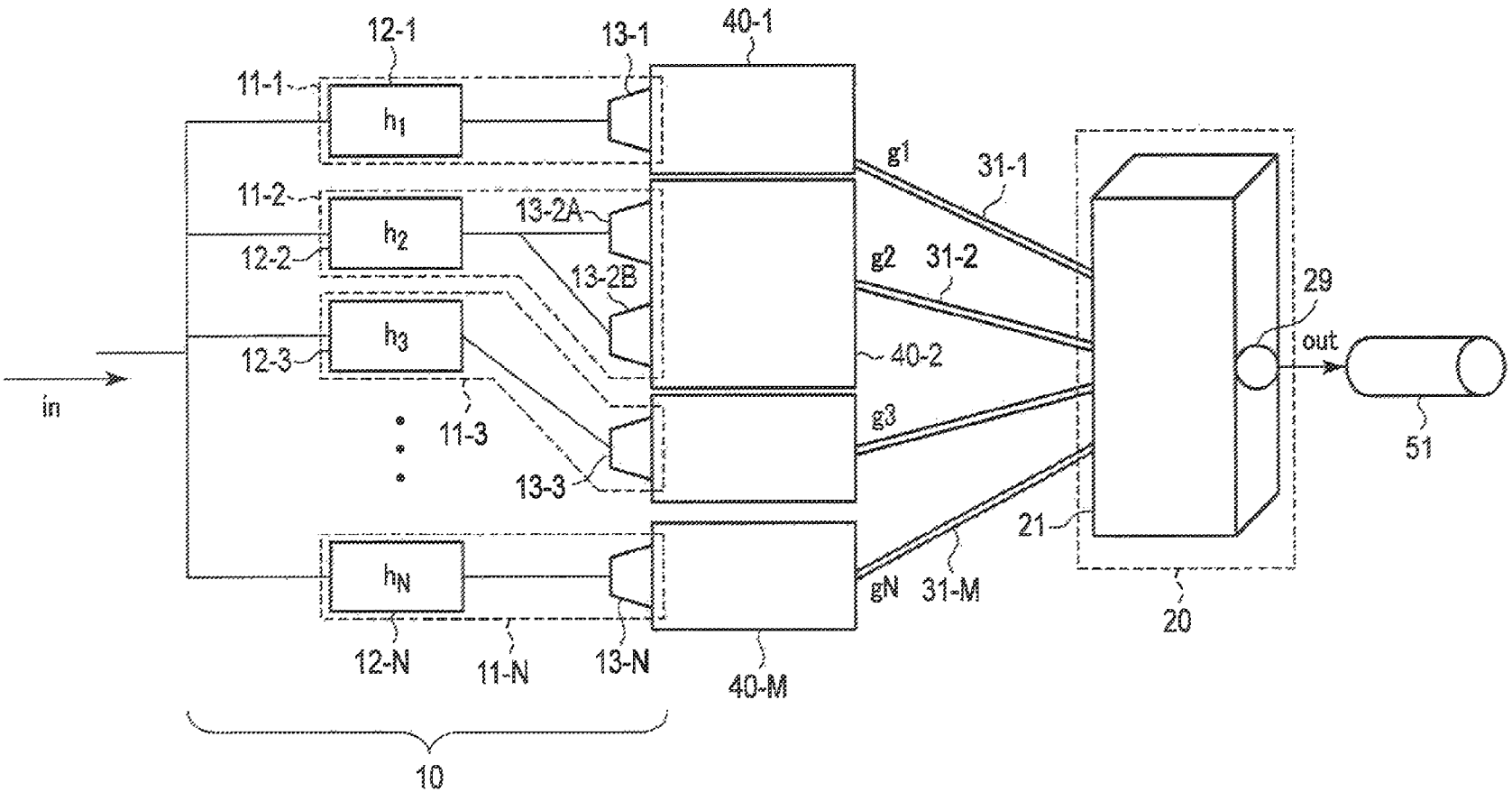
FIG. 15 is a schematic diagram depicting yet another example of the speaker system according to the second embodiment.

FIG. 15 schematically depicts yet another example of the speaker system according to the second embodiment. In the speaker system depicted in FIG. 15, a sound wave generation unit 11-2 includes a filter 12-2 and two speakers 13-2A and 13-2B. A signal output from the filter 12-2 is branched into two pathways. One of the resultant signals is provided to the speaker 13-2A, whereas the other signal is provided to the speaker 13-2B. The speakers 13-2A and 13-2B are arranged at symmetric positions with respect to a position where the tube 31-2 is connected to the resonance box 40-2. This configuration has the advantage of being able to increase the sound pressure at the connection position of the tube 31 compared to a configuration where one speaker 13 is connected to the resonance box 40.

Figure 16:
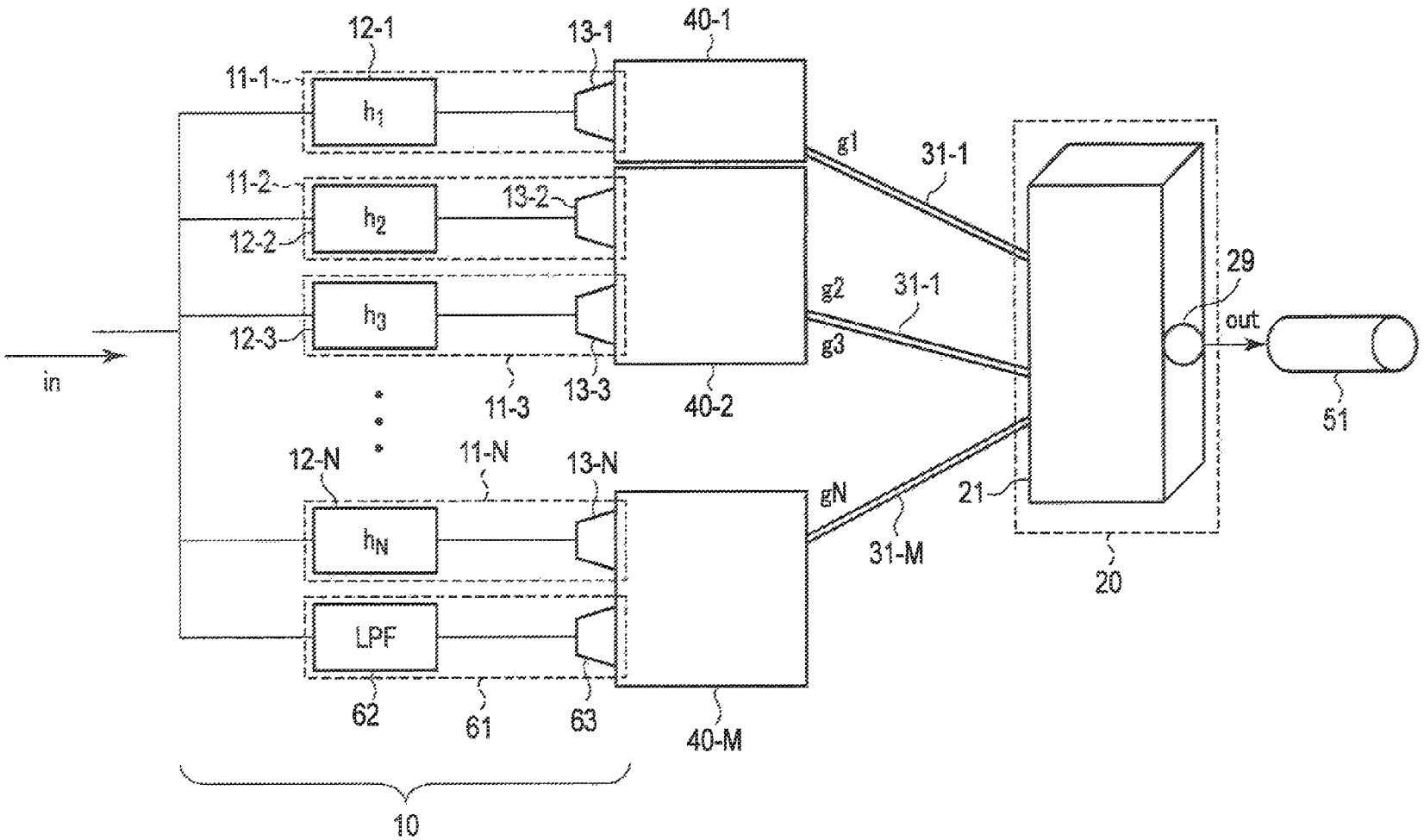
FIG. 16 is a schematic diagram depicting still another example of the speaker system according to the second embodiment.

FIG. 16 schematically depicts still another example of the speaker system according to the second embodiment. The speaker system depicted in FIG. 16 includes, in addition to the elements of the speaker system depicted in FIG. 13, a second sound wave generation unit 61 including a low pass filter (LPF) 62 and a speaker 63. The speaker 63 is connected to a resonance box to which a speaker 13-*i* of any sound wave generation unit 11-*i* is connected. In the example in FIG. 16, the speaker 63 is fixed to a resonance box 40-M along with a speaker 13-N. In FIG. 16, $g_f$ denotes the transfer characteristic from the speaker 63 to the evaluation point 29.

A signal provided to the sound wave generation unit 61 is the same as the input signal input to the speaker unit 10. That is, a signal provided to the sound wave generation unit 61 is the same as the signal provided to sound wave generation units 11-1, 11-2, . . . , 11-N. The low pass filter 62 removes, from the input signal, components with frequencies not less than the resonant frequency of the resonance box 40-M. The speaker 63 is a flat speaker that can emit plane sound waves, and converts a signal output from the low pass filter 62 into a sound wave.

To allow a first-order mode of the resonance box 40 to be set for a low frequency, the resonance box 40 needs to be larger in size, leading to the need for a large space. The use of a flat speaker allows for compensation of a frequency band for which the sound pressure fails to be increased using the resonance box. The low pass filter 62 is used in order to avoid interference with the speaker 13-N that outputs sound waves of high frequencies.

It should be noted that, even when the resonance box 40 is provided, the structure of the sound collection unit 20 may be obtained by applying one or more structures described in the first embodiment.

As described above, the speaker system according to the second embodiment enables an increase in sound pressure by connecting the speaker to the tube via the resonance box.

Figure 17:
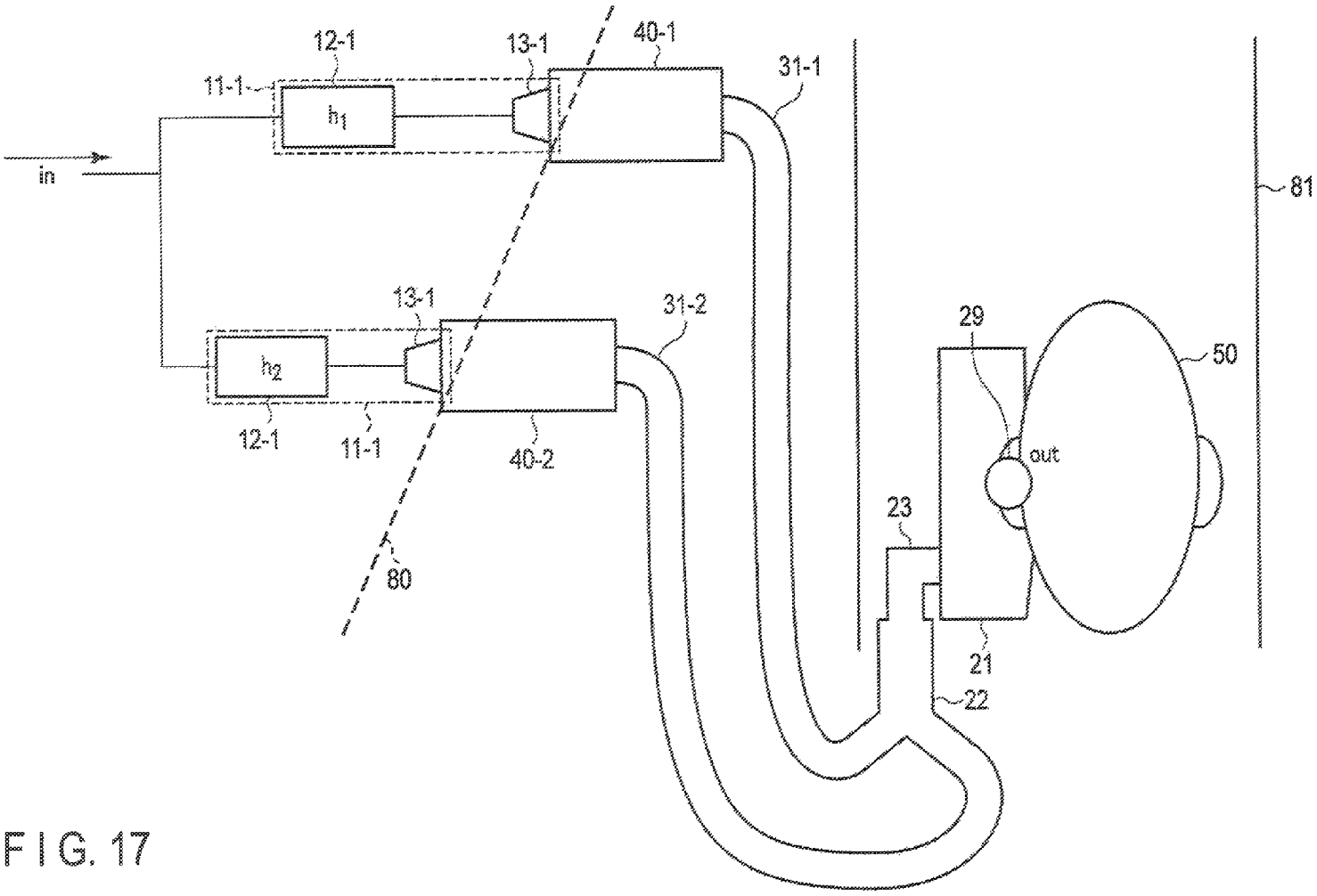
FIG. 17 is a schematic diagram depicting an example in which the speaker system according to the second embodiment is applied to the MRI apparatus.

The speaker system according to at least one of the above-described embodiments enables a reduction in the difference in frequency characteristic between the input signal and the output signal by using the filters designed so as to match the transfer characteristic from the input signal to the output signal with the target transfer characteristic. The speaker system according to at least one of the above-described embodiments can be applied, for example, to an MRI apparatus. FIG. 17 depicts an example in which the speaker system according to the second embodiment is applied to an MRI apparatus. A subject (listener) 50 is placed in a bore 81 of the MRI apparatus. The resonance boxes 40-1 and 40-2, the tubes 31-1 and 31-2, a path joining part 22, a transmission tube 23, and the transmission part 21 may be made of a nonmagnetic material. The speaker system can be applied to the MRI apparatus by placing the above-described elements in a periphery 80 of the MRI apparatus that is a strong magnetic field environment.

When a sound source and a sound receiving point are present in a resonance box shaped like a rectangular parallelepiped, the transfer characteristic P of the sound pressure is expressed as follows.

$$P(\omega) = \left\{ j\omega\rho c^2 \sum_n \frac{\phi_n(x_1)\phi_n(x_2)}{\varepsilon_n[\omega_n^2 - \omega^2 + 2j\beta\omega]} \right\} \Big/ (l_x l_y l_z) \tag{2}$$

-continued $$\phi_n = \cos(x\pi n_x / l_x)\cos(y\pi n_y / l_y)\cos(z\pi n_z / l_z) \quad (3)$$

$$\omega_{n_x n_y n_z} = c\pi\sqrt{(n_x / l_x)^2 + (n_y / l_y)^2 + (n_z / l_z)^2} \quad (4)$$

In the formulae, $l_x$, $l_y$, and $l_z$ denote dimensions of a box, $\phi_n$ denotes a mode function, and $\omega_{n_x n_y n_z}$ denotes a natural angular frequency. β is a constant determined by a reverberation time and having a value that can be changed in accordance with the average sound absorption coefficient, according to the present embodiment $\epsilon_n$ denotes a value referred to as a modal mass, $x_1$ denotes the position ($x_a$, $y_a$, $z_a$) of the sound source, and $x_2$ denotes the position ($x_b$, $y_b$, $z_b$) of the sound receiving point. ρ denotes density, and c denotes sound velocity, $n_x$, $n_y$, and $n_z$ denote integers, and a combination of $n_x$, $n_y$, and $n_z$ is denoted by n. The sound receiving point corresponds to the connection position of the tube 31.

According to Formula (3), when, for example, the position $x_1$ of the sound source is ($l_x/3$, $l_y/3$, $l_z/3$), the natural angular frequencies in Formula (4) are all excited. This is because n is an integer, thus preventing cos (πn/3) from being zeroed. On the other hand, if the position $x_1$ of the sound source is ($l_x/2$, $l_y/3$, $l_z/3$), then for $n_x$=1, 3, 5, . . . , cos ($\pi n_x/2$) is zero, that is, ($\phi_n$=0. Thus, the natural angular frequencies in Formula (4) include an unexcited mode. Furthermore, when the position $x_1$ of the sound source is any one of the four corners of the box represented by (0, 0, 0), ($l_x$, $l_y$, $l_z$), or the like, all modes are excited at the maximum value of the mode function, that is, 1.

The sound pressure is more effectively increased by utilizing all the resonance modes of the resonance box, that is, exciting all the natural angular frequencies. This will be described below. The sound pressure increase effect exerted by the resonance box 40 according to the second embodiment will be described using two boxes depicted in FIG. 18A and FIG. 18B.

Figure 18B:
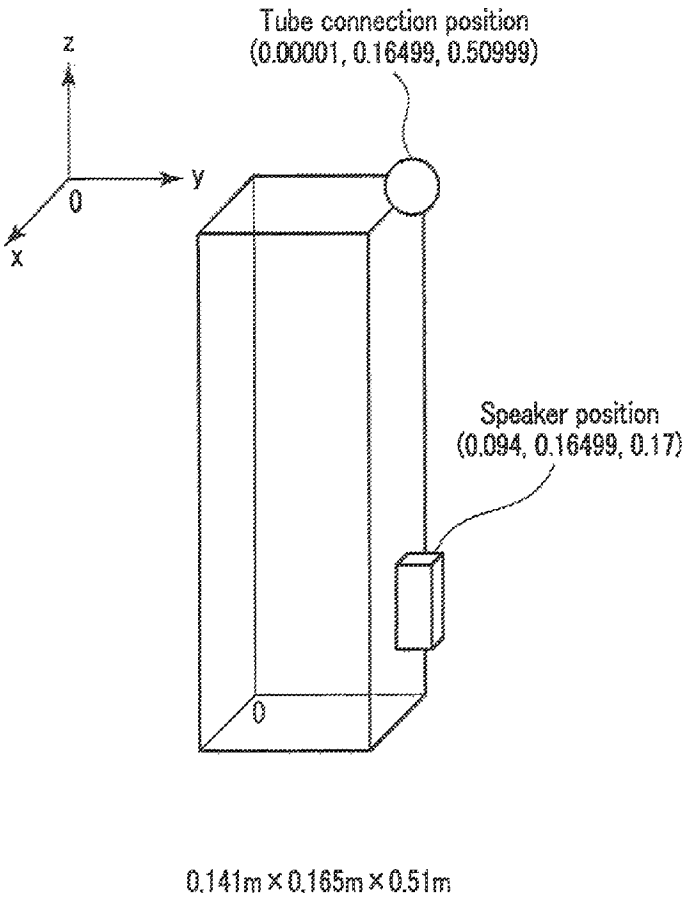
FIG. 18A and FIG. 18B are diagrams depicting design examples of a speaker position and a tube connection position on a resonance box.
Figure 18A:
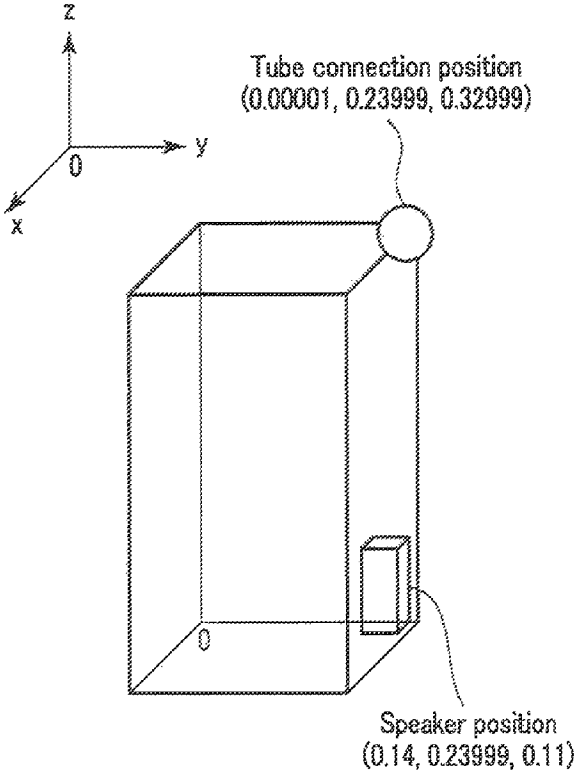

A box 1 depicted in FIG. 18A is 0.21 m×0.24 m×0.33 m in dimensions. A speaker position $x_1$ is (0.14, 0.23999, 0.11), and a tube position $x_2$ is (0.00001, 0.23999, 0.32999). Likewise, a box 2 depicted in FIG. 18B is 0.141 m×0.165 m×0.51 m in dimensions. The speaker position $x_1$ is (0.094, 0.16499, 0.17), and the tube position $x_2$ is (0.00001, 0.16499, 0.50999). The speaker position as used herein refers to the position of a speaker cone. First, with the natural angular frequencies in Formula (4) taken into account, values having reciprocals of approximately 2, 3, 4, 5, 6, and 7 are assigned to the dimensions of the box 1 and the box 2. This changes the effect of each side on the natural angular frequencies, enabling a consequent increase in the number of natural angular frequencies. Furthermore, the reciprocals are not perfect reciprocals, but multiples of 3 are used considering that the speaker is placed at a position corresponding to one third of the side. Desirably, both the speaker position and the tube connection position are normally any one of the four corners of the box in terms of mode excitation. However, speakers with high output volumes are ordinarily of a box type and are thus attached to a surface of the box. In other words, the position of the speaker cone is set to a position (one third of a side, one third of a side) on the surface. The values 0.00001, 0.50999, and the like mean contact with the surface. In actual implementation, this disposition requires the protrusion of the boxes 1 and 2 by an amount equal to the size of the box but is feasible. When the sound volume is secondarily taken into account, small speakers may be used, and thus, the speaker may be installed at any one of the four corners. The tube is flexible and takes up little space, and thus, the tube connection position is set to one of the four corners. The setting according to the second embodiment can be summarized as follows. This disposition allows the modes to be excited to a lower degree than a case where the speaker is installed at any one of the four corners of the box, but allows all the modes to be excited. Additionally, the boxes 1 and 2 excite different modes, and thus, the combination of the box 1 and the box 2 generally increases mode density.

Figure 19:
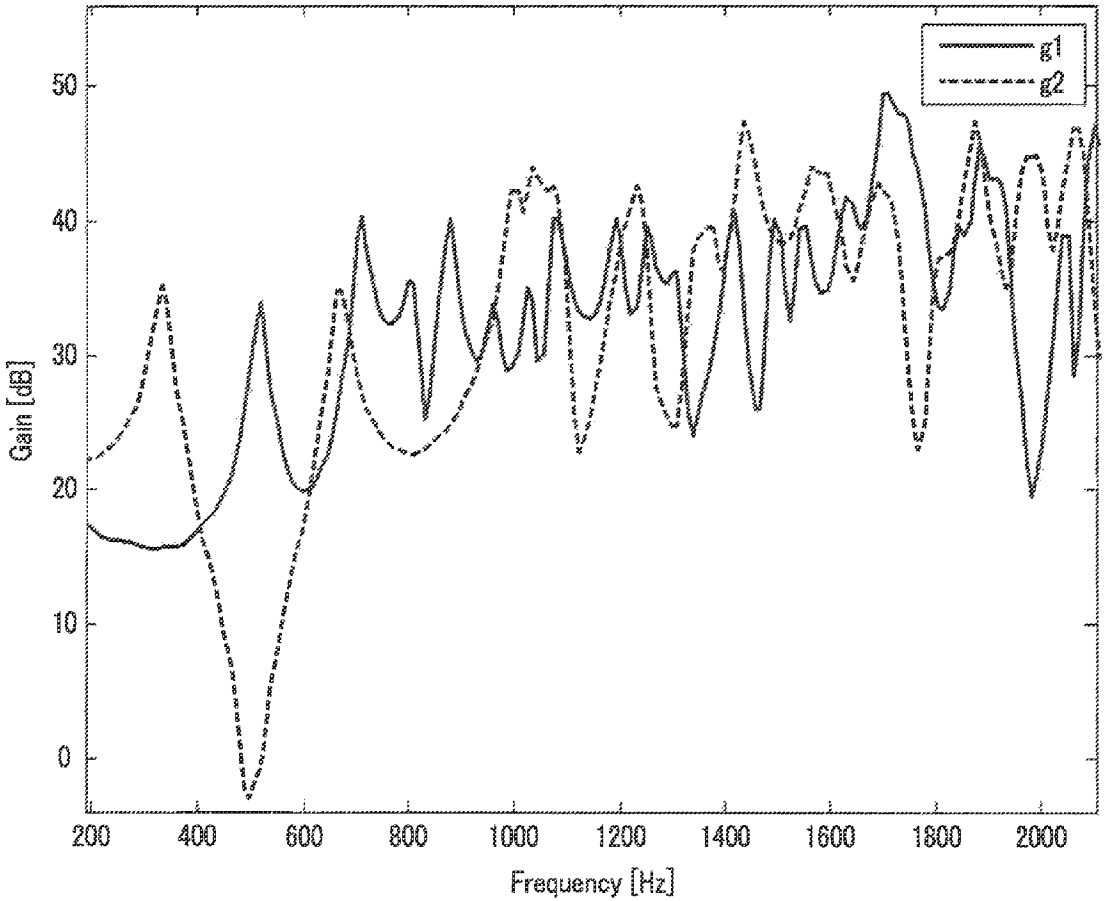
FIG. 19 is a diagram depicting transfer functions for the resonance boxes depicted in FIG. 18A and FIG. 18B.

FIG. 19 depicts the transfer characteristic $g_1$ (depicted by a solid line) from the sound source (that is the speaker position) to the sound receiving point (that is, the tube connection position) in the box 1 and the transfer characteristic $g_2$ (depicted by a dashed line) from the sound source to the sound receiving point in the box 2. A comparison between the transfer characteristics $g_1$ and $g_2$ indicates that the transfer characteristics $g_1$ and $g_2$ differ from each other in resonant frequency, particularly a frequency at which a notch occurs. That is, FIG. 19 indicates that a combination of the structures depicted in FIGS. 18A and 18B allows the transfer characteristic from the input to the output to be made desirable. Furthermore, the active use of resonance enables an increase in sound pressure.

Figure 20:
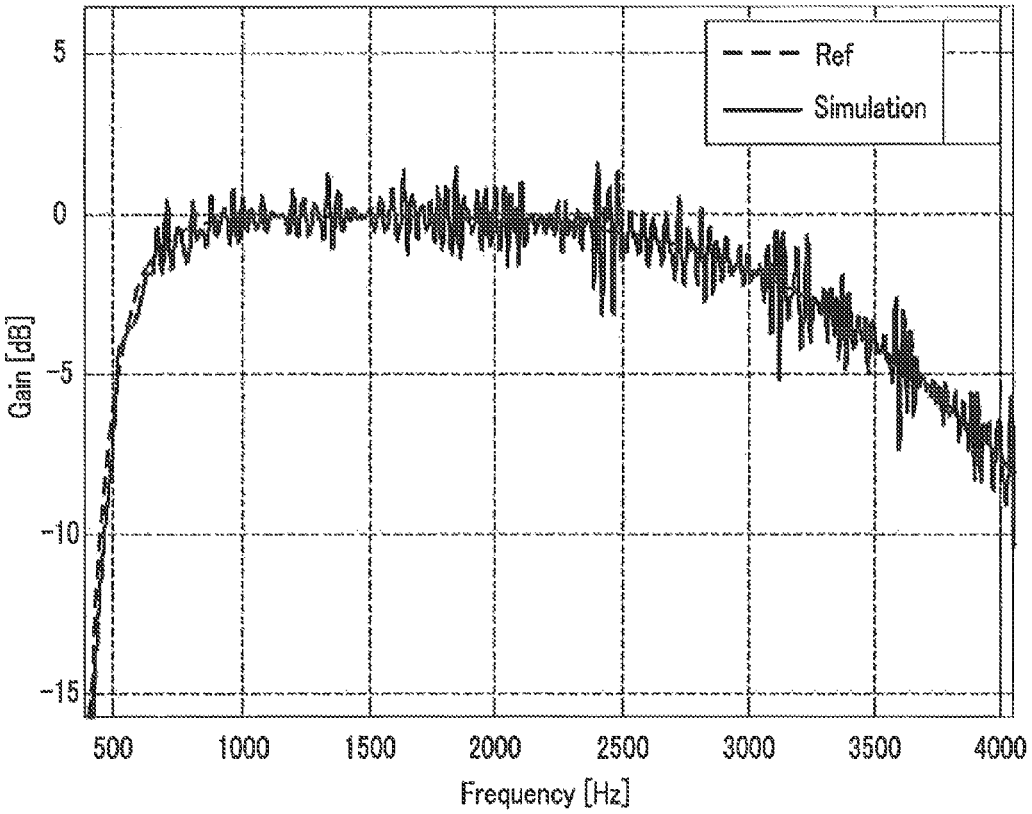
FIG. 20 is a diagram depicting a transfer characteristic from an input signal to an output signal in the speaker system depicted in FIG. 13.

FIG. 20 depicts the transfer characteristic from the input signal (in) to the output signal (out) in the speaker system depicted in FIG. 13. FIG. 20 indicates that a transfer characteristic approximately similar to the target transfer characteristic has been successfully achieved. This verification does not take the transfer characteristics of the tube and the sound collection unit 20 into account. Even when the tube exhibits a transfer characteristic, since the resonance box has a different transfer characteristic, the second embodiment allows the transfer characteristic of the tube to be appropriately compensated for.

Figure 21B:
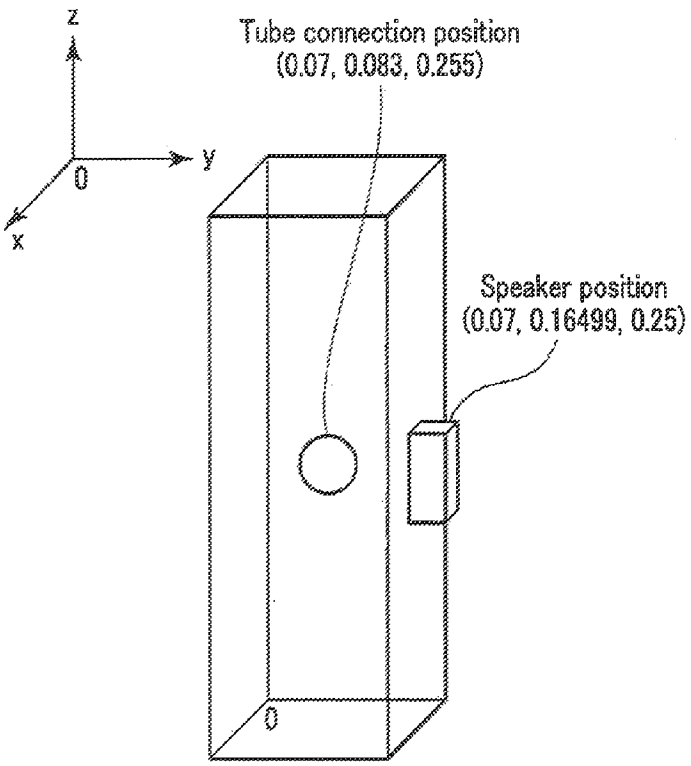
FIG. 21A and FIG. 21B are diagrams depicting design examples of the speaker position and the tube connection position on a resonance box.
Figure 21A:
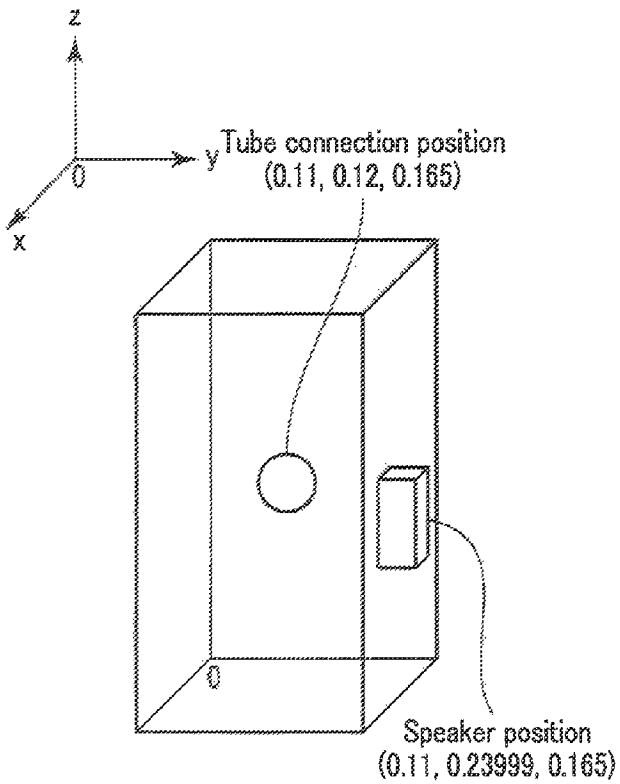
Figure 22:
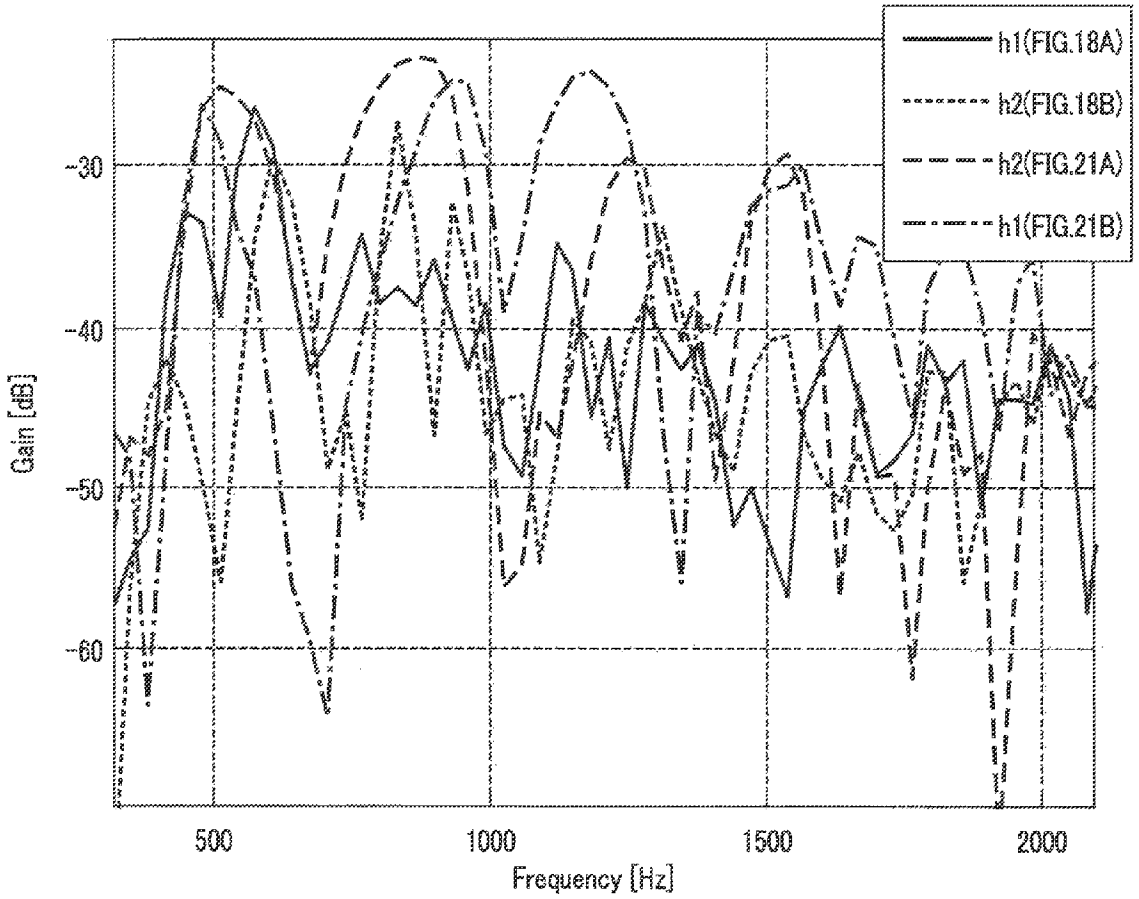
FIG. 22 is a diagram depicting transfer functions for the resonance boxes depicted in FIG. 18A and FIG. 18B and transfer functions h1 and h2 for the resonance boxes depicted in FIG. 21A and FIG. 21B.

The sound amplification effect will be described with reference to FIG. 21A, FIG. 21B, and FIG. 22. A box 1 depicted in FIG. 21A is the same as the box 1 depicted in FIG. 18A in dimensions. A box 2 depicted in FIG. 21B is the same as the box 2 depicted in FIG. 18B in dimensions. In the box 1 in FIG. 21A, the speaker position is (0.11, 0.23999, 0.165), and the tube connection position is (0.11, 0.12, 0.165). In the box 2 in FIG. 21B, the speaker position is (0.07, 0.16499, 0.25), and the tube connection position is (0.07, 0.083, 0.255). In this disposition, the speaker is placed at a position corresponding to half of a side of the box, and thus, some modes are unexcited. FIG. 22 depicts a comparison between the frequency characteristics of filters h1 and h2 designed in association with FIGS. 18A and 18B and FIGS. 21A and 21B. In FIG. 22, a solid line depicts the transfer characteristic h1 of the box 1 in FIG. 18A, and a dot line depicts the transfer characteristic h2 of the box 2 in FIG. 18B. A dashed line depicts the transfer characteristic h1 of the box 1 in FIG. 21A, and an alternate long and short dashed line depicts the transfer characteristic h2 of the box 2 in FIG. 21B. FIG. 22 indicates that the gains of the transfer characteristic h1 of the box 1 in FIG. 21A and the transfer characteristic h2 of the box 2 in FIG. 21B are generally higher than the gains of transfer characteristic h1 of the box 1 in FIG. 18A and the transfer characteristic h2 of the box 2 in FIG. 18B. The high gains of the filters h1 and h2 mean that high voltages are input to the speakers even when the same signal input (in) is applied. In other words, a higher gain of the filter causes the limitation of the input voltage to the speaker to be reached with a lower level of the input signal. In other words, the setting in FIG. 21A and FIG. 21B allows the speaker limit to be reached earlier than the setting in FIG. 18A and FIG. 18B as the signal input (in) is increased. In short, the setting in FIG. 18A and FIG. 18B allows a level of the input signal to be made higher, enabling an increase in the sound pressure at the output end (out). As described above, the sound pressure is expected to be successfully increased by adequately utilizing the resonance in the resonance box as is the case with the setting in FIG. 18A and FIG. 18B.

The results of the simulation indicate that by appropriate design of the resonance box, the speaker position, and the tube connection position allows appropriate input/output relations to be achieved, thus enabling implementation of a speaker system that can output a high sound pressure. The above-described design pattern of the resonance boxes is illustrative, and any other design pattern may be applied.

While certain embodiments have been described, these embodiments have been presented by way of example only and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. A speaker system comprising:

a plurality of filters, each of which filters a first signal to generate a second signal;

a plurality of speakers arranged so that transfer characteristics from the plurality of speakers to an evaluation point are different from each other, each of the plurality of speakers converting the second signal generated by a corresponding one of the plurality of filters into a sound wave; and a sound collection unit configured to combine sound waves output from the plurality of speakers to generate a combined sound wave, wherein the plurality of filters are formed so that a transfer characteristic from the first signal to an output signal matches a target transfer characteristic, the output signal indicating a sound pressure of the combined sound wave at the evaluation point.

2. The system according to claim 1, wherein the sound collection unit includes a transmission part configured to transmit the combined sound wave to an external auditory meatus of a listener.

3. The system according to claim 2, wherein the sound collection unit further includes a joining part in which transmission paths of the sound waves join together and a tube connecting the joining part to the transmission part to transmit the combined sound wave from the joining part to the transmission part.

4. The system according to claim 2, wherein the transmission part is shaped to be able to be inserted into the external auditory meatus of the listener.

5. The system according to claim 2, wherein the transmission part is shaped to cover an external ear of the listener.

6. The system according to claim 2, wherein the transmission part includes a first part with a first cross section and a replaceable second part with a second cross section different from the first cross section.

7. The system according to claim 2, wherein the transmission part includes a main body part with an internal space and a tube part extending from the main body part.

8. The system according to claim 1, further comprising a plurality of tubes connecting the plurality of speakers to the sound collection unit to transmit the sound waves from the plurality of speakers to the sound collection unit.

9. The system according to claim 1, further comprising:

a resonance box to which at least one of the plurality of speakers is connected; and a tube connecting the resonance box to the sound collection unit to transmit a sound wave output from the at least one of the plurality of speakers to the sound collection unit.

10. The system according to claim 9, further comprising a low pass filter which removes, from the first signal, components with frequencies not less than a resonant frequency of the resonance box to generate a third signal; and a flat speaker, connected to the resonance box, which converts the third signal into a sound wave.

11. The system according to claim 1, further comprising:

another speaker which converts a second signal output from one of the plurality of filters into a sound wave;

a resonance box to which a speaker corresponding to the one of the plurality of filters and the other speaker are connected;

and a tube connecting the resonance box to the sound collection unit, wherein the speaker corresponding to the one of the plurality of filters and the other speaker are arranged on the resonance box so as to be symmetric with respect to a position where the tube is connected to the resonance box.

12. The system according to claim 1, wherein the evaluation point is set near an inlet of an external auditory meatus of a listener.

13. The system according to claim 1, wherein the target transfer characteristic is set to exhibit a flat frequency characteristic in a specified frequency band.

14. A speaker system comprising:

a filter which filters a first signal to generate a second signal;

a speaker which converts the second signal into a sound wave;

a resonance box connected to the speaker;

a transmission part configured to transmit the sound wave to a listener; and a tube connecting the resonance box to the transmission part to transmit the bound wave to the transmission part, wherein a transfer characteristic of the filter is an approximate inverse characteristic of a transfer characteristic from the speaker to an evaluation point set in the transmission part.

* * * * *